US005444605A

United States Patent [19]

Rivera

[11] Patent Number: 5,444,605

[45] Date of Patent: Aug. 22, 1995

[54] ILLUMINATION DEVICE FOR A PURSE

[76] Inventor: Eric J. Rivera, 34 Arpage Dr., Shirley, N.Y. 11967

[21] Appl. No.: 252,833

[22] Filed: Jun. 2, 1994

[51] Int. Cl.[6] ..... A45C 15/06

[52] U.S. Cl. ..... 362/156; 362/253; 362/191

[58] Field of Search ..... 362/156, 137, 190, 191, 362/154, 155; 150/114, 106, 100, 126

[56] References Cited

U.S. PATENT DOCUMENTS

| | | | |
|---|---|---|---|
| 2,179,214 | 11/1939 | Hallbauer | 362/156 |
| 2,304,387 | 12/1942 | Whiting et al. | 362/156 |
| 2,558,606 | 6/1952 | Crockett | 362/156 |
| 2,611,573 | 9/1952 | Young | 362/156 X |
| 3,609,342 | 9/1971 | Wisniewski | 362/156 |
| 4,091,443 | 5/1978 | Ohrenstein et al. | 362/156 |
| 4,654,763 | 3/1987 | Knight | 362/156 |
| 4,742,438 | 5/1988 | King | 362/156 |
| 4,954,934 | 9/1990 | Kidder et al. | 362/156 |
| 5,005,111 | 4/1991 | Ten | 362/156 |

*Primary Examiner*—Ira S. Lazarus
*Assistant Examiner*—Thomas M. Sember
*Attorney, Agent, or Firm*—Michael I. Kroll

[57] ABSTRACT

An illumination device is provided for a purse of the type having a body with side gussets, a frame with a knob closure, a carry handle, a shoulder strap attached to the side gussets by loops and an inner pocket with a slide fastener. The device comprises a housing removably attached to the purse, so as to hang within the interior of the body. A power source is on the housing. A light source on the housing is connected via an electric circuit to the power source. A component is for opening and closing the electrical circuit to turn the light source on and off. When the light source is turned on, it will supply a sufficient amount of illumination within the body of the purse to allow a person to find small objects.

6 Claims, 2 Drawing Sheets

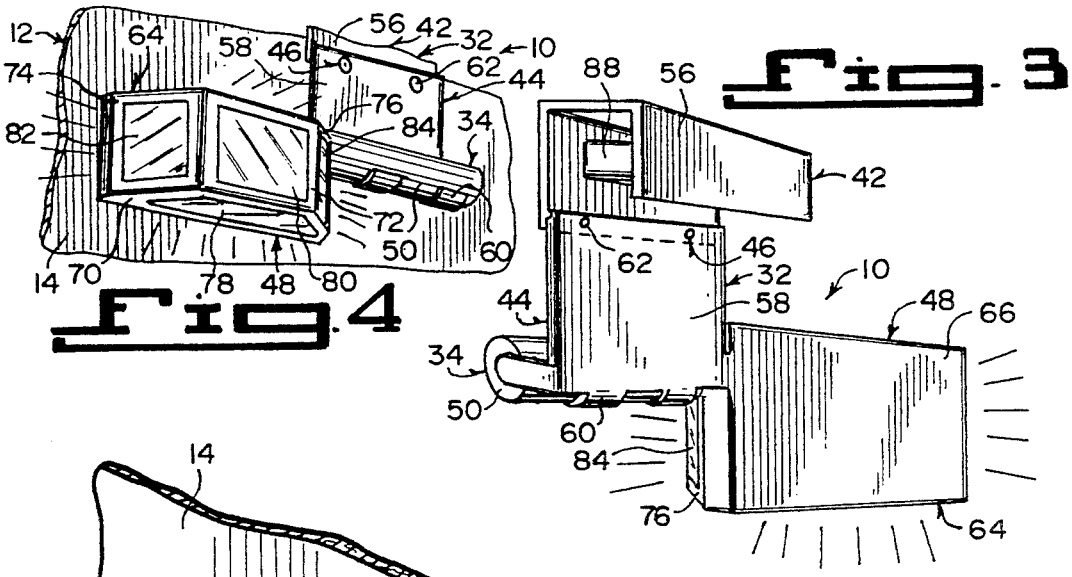
Fig. 3
Fig. 4
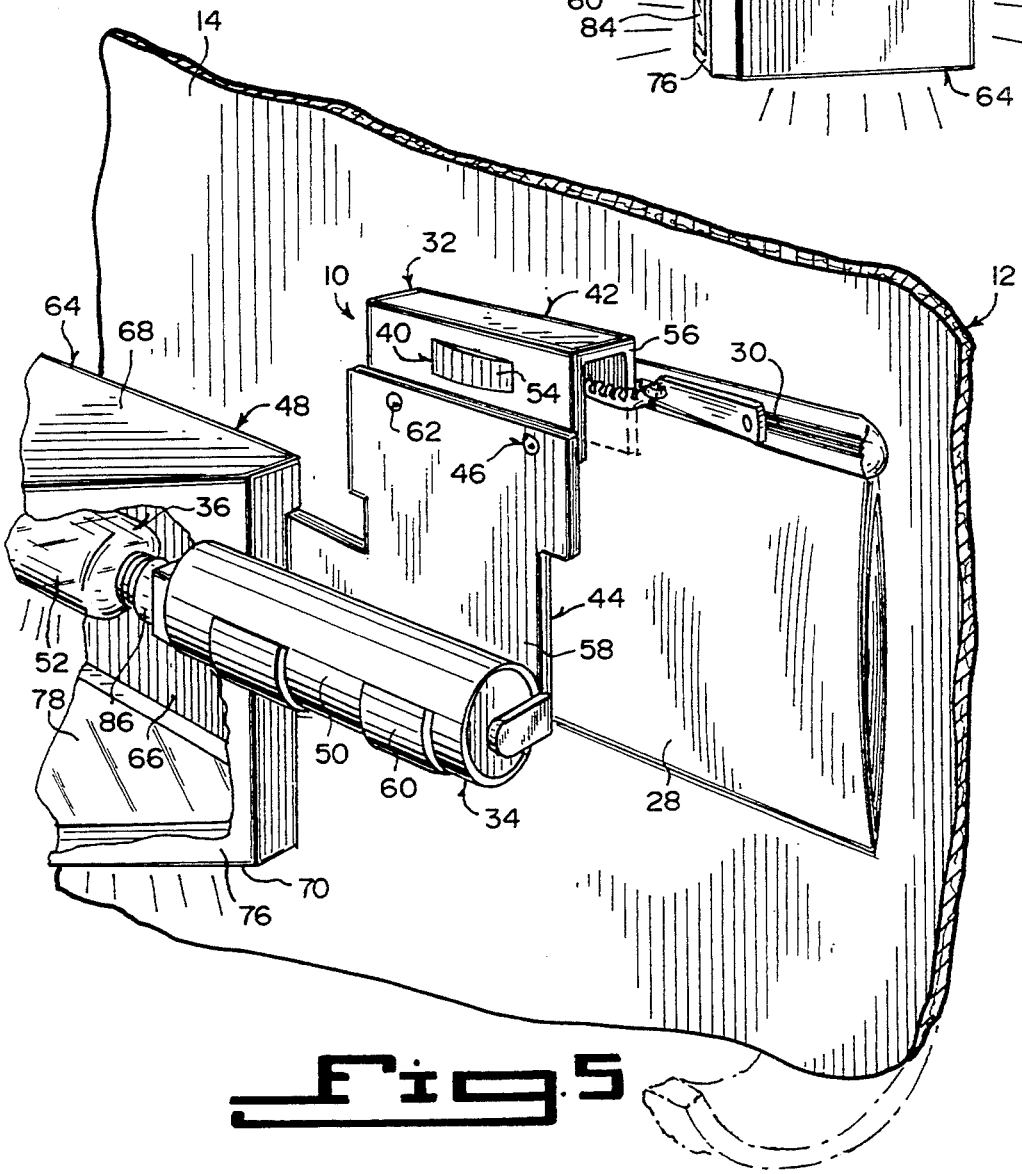
Fig. 5

ILLUMINATION DEVICE FOR A PURSE

BACKGROUND OF THE INVENTION

1. Field of the Invention

The instant invention relates generally to flashlights and more specifically it relates to an illumination device for a purse.

2. Description of the Prior Art

Numerous flashlights have been provided in prior art that are adapted to be small battery operated portable hand held light sources. While these units may be suitable for the particular purpose to which they address, they would not be as suitable for the purposes of the present invention as heretofore described.

SUMMARY OF THE INVENTION

A primary object of the present invention is to provide an illumination device for a purse that will overcome the shortcomings of the prior art devices.

Another object is to provide an illumination device for a purse that contains a housing which is removably attached to the purse to hang within the interior thereof, so that when the device is activated, it will supply sufficient light therein allowing a person to find small objects.

An additional object is to provide an illumination device for a purse in which a bracket portion of the housing can hang upon the frame or from an inner pocket of the purse, so that a lens assembly of the housing containing a light bulb can cast light in a plurality of different directions to efficiently light up the interior of the purse.

A further object is to provide an illumination device for a purse that is simple and easy to use.

A still further object is to provide an illumination device for a purse that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a still further enlarged rear perspective view of the instant invention per se taken in the direction of arrow 3 in FIG. 2.

FIG. 4 is a front perspective view with the bracket of the housing broken away taken in the direction of arrow 4 in FIG. 2.

FIG. 5 is a front perspective view with parts broken away, showing a second embodiment of the instant invention installed on an inner pocket of the purse.

DETAILED DESCRIPTION OF THE PREFERRED EMBODIMENTS

Figure 1A:
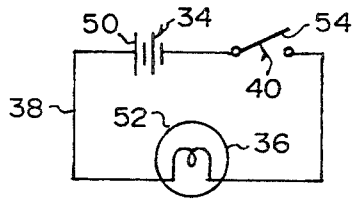
FIG. 1A is a schematic electrical diagram of the instant invention.

Turning now descriptively to the drawings, in which similar reference characters denote similar elements throughout the several views, FIGS. 1 through 5 illustrate an illumination device 10 for a purse 12 of the type having a body 14 with side gussets 16, a frame 18 with a knob closure 20, a carry handle 22, a shoulder strap 24 attached to the side gussets 16 by loops 26 and an inner pocket 28 with a slide fastener 30. The device 10 consists of a housing 32 removably attached to the purse 12, so as to hang within the interior of the body 14. A power source 34 is on the housing 32. A light source 36 on the housing 32 is connected via an electric circuit 38 to the power source 34. A component 40 is for opening and closing the electrical circuit 38 to turn the light source 36 on and off. When the light source 36 is turned on it will supply a sufficient amount of illumination within the body 14 of the purse 12, to allow a person to find small objects.

The housing 32 includes a bracket 42 for removable attachment to the purse 12. A holder 44 is for the power source 34. Elements 46 are for connecting the holder 44 to the bracket 42. A lens assembly 48 for the light source 36 is to diffuse the illumination from the light source 36 into the body 14 of the purse 12. The power source 34 is a battery 50. The light source 36 is a light bulb 52. The opening and closing component 40 is an on/off switch 54.

Figure 1:
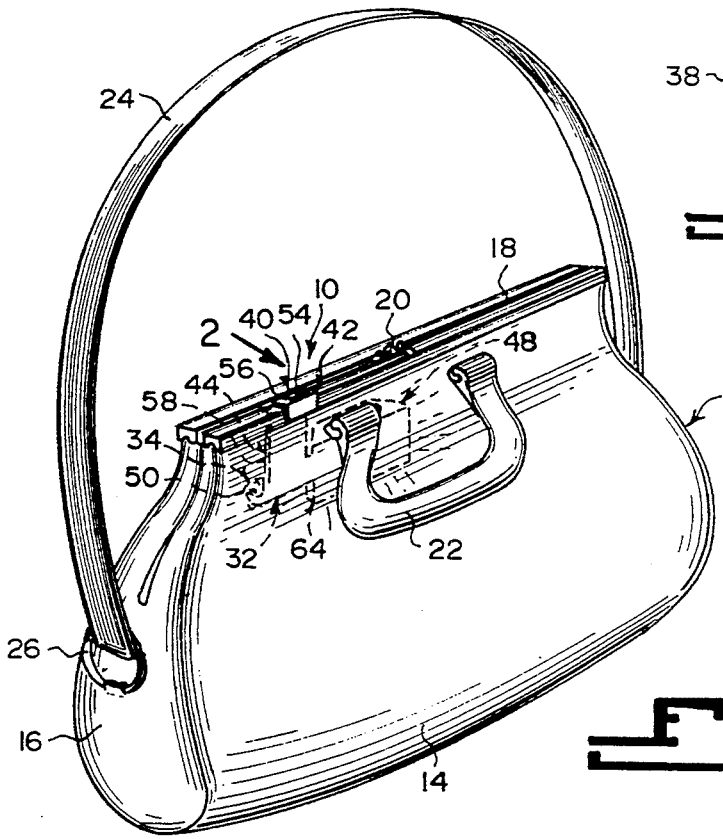
FIG. 1 is a rear perspective view of a purse with the instant invention installed therein.
Figure 2:
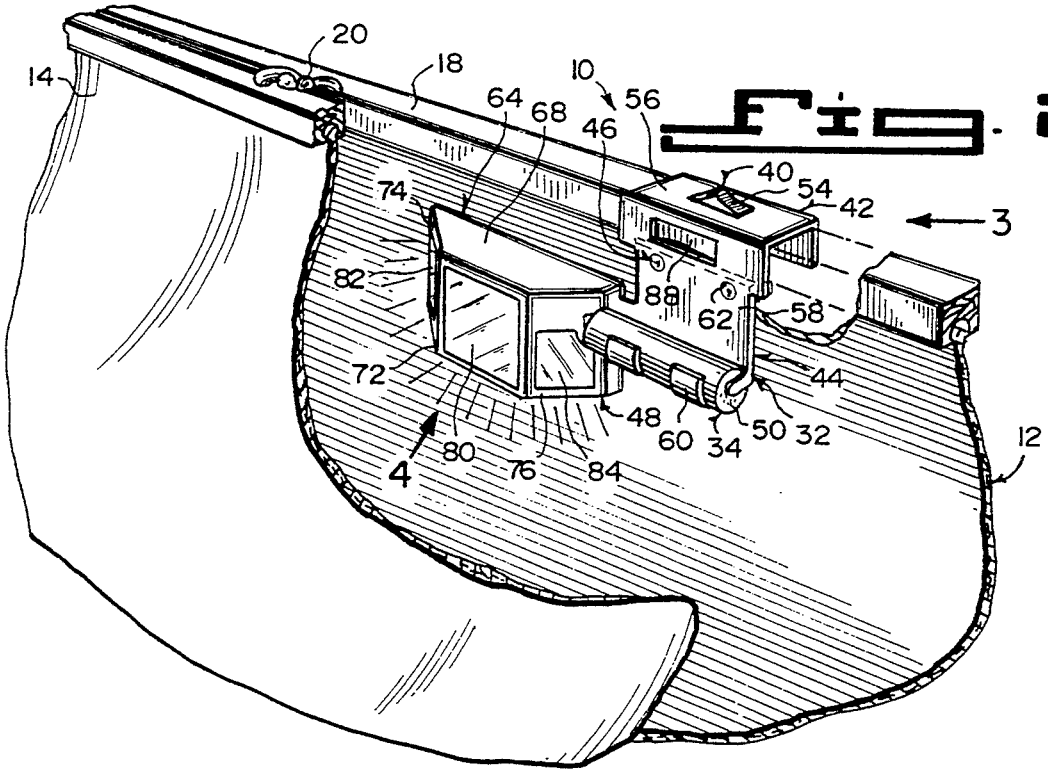
FIG. 2 is an enlarged front perspective view taken in the direction of arrow 2 in FIG. 1 with parts of the purse broken away, showing the instant invention in greater detail.

The bracket 42 is an inverted U-shaped channel member 56, which can in a first instance engage with the frame 18 of the purse 12, as shown in FIGS. 1 and 2 and in a second instance engage with the inner pocket 28 when the slide fastener 30 is partly opened, as shown in FIG. 5. The holder 44 is a plate 58, having at least one U-shaped clamp 60 for retaining the battery 50. The connecting elements 46 are a plurality of rivets 62, for fastening an upper edge of the plate 58 to one side leg of the channel member 56.

The lens assembly 48 consists of a casing 64 extending from one side edge of the plate 58 and has a back reflector wall 66, a top wall 68, a bottom wall 70, a front wall 72 and a pair of tapered side walls 74, 76. Four lens panels 78, 80, 82, 84 are provided. The first lens panel 78 is mounted in the bottom wall 70. The second lens panel 80 is mounted on the front wall 72. The third lens panel 82 is mounted in the first tapered side wall 74. The fourth lens panel 84 is mounted in the second tapered side wall 76, for diffusing the illumination.

The casing 64 contains a socket 86, as best seen in FIG. 5, for the light bulb 52 that is connected via the electric circuit 38 between the battery 50 and the on/off switch 54. A spring clip 88, shown in FIGS. 2 and 3, can be in the one side leg of the channel member 56 of the bracket 42 to better engage with the frame 18 of the purse 12.

OPERATION OF THE INVENTION

To use the illumination device 10, the following steps should be taken:

1. Open the purse 12 by releasing the knob closure 20.
2. Install the channel member 56 of the bracket 42 either onto the frame 18, as shown in FIGS. 1 and 2, or on the inner pocket 28, as shown in FIG. 5.
3. Close the purse 12 by engaging the knob closure 20.

4. Reopen the purse 12 by releasing the knob closure 20 again.
5. Turn the switch 54 to the on position to cause the light bulb 52 within the casing 64 to go on, so that the illumination will be diffused therein to light up the interior of the body 14 of the purse 12, to locate the small articles therein.
6. Turn the switch 54 to the off position to cause the light bulb 52 to go out.
7. Reclose the purse 12 by engaging the knob closure 20 again.

LIST OF REFERENCE NUMBERS

10 illumination device
12 purse
14 body of 12
16 side gusset on 14
18 frame on 14
20 knob closure on 18
22 carry handle of 12
24 shoulder strap
26 loop between 24 and 16
28 inner pocket in 14
30 slide fastener on 28
32 housing of 10
34 power source on 32
36 light source on 32
38 electric circuit
40 opening and closing component
42 bracket of 32
44 holder of 32
46 connecting element
48 lens assembly
50 battery for 34
52 light bulb for 36
54 on/off switch for 40
56 inverted U-shaped channel member for 42
58 plate for 44
60 U-shaped clamp on 58
62 rivet for 46
64 casing of 48
66 back reflector wall of 64
68 top wall of 64
70 bottom wall of 64
72 front wall of 64
74 first tapered side wall of 64
76 second tapered side wall of 64
78 first lens panel in 70
80 second lens panel in 72
82 third lens panel in 74
84 fourth lens panel in 76
86 socket in 64 for 52
88 spring clip in 56

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An illumination device for a purse of the type having a body with side gussets, a frame with a knob closure, a carry handle, a shoulder strap attached to the side gussets by loops and an inner pocket with a slide fastener, said device comprising:

a) a housing removably attached to the purse, so as to hang within the interior of the body, said housing including a bracket for removable attachment to the purse, said bracket being an inverted U-shaped channel member which can in a first instance engage with the frame of the purse and in a second instance engage with the inner pocket when the slide fastener is partly opened, a holder for said power source, means for connecting said holder to said bracket, and a lens assembly for said light source to diffuse the illumination from said light source into the body of the purse;

b) a power source on said housing, said power source being a battery;

c) a light source on said housing connected via an electric circuit to said power source, said light source being a light bulb; and d) means for opening and closing the electrical circuit to turn said light source on and off, so that when said light source is turned on it will supply a sufficient amount of illumination within the body of the purse to allow a person to find small objects, said opening and closing means being an on/off switch.

2. An illumination device for a purse as recited in claim 1, wherein said holder is a plate having at least one U-shaped clamp for retaining said battery.

3. An illumination device for a purse as recited in claim 2, wherein said connecting means includes a plurality of rivets for fastening an upper edge of said plate to one side leg of said channel member.

4. An illumination device for a purse as recited in claim 3, wherein said lens assembly includes:

a) a casing extending from one side edge of said plate and having a back reflector wall, a top wall, a bottom wall, a front wall and a pair of tapered side walls; and b) four lens panels in which a first lens panel is mounted in said bottom wall, a second lens panel is mounted on said front wall, a third lens panel is mounted in a first tapered side wall and a fourth lens panel is mounted in a second tapered side wall for diffusing the illumination.

5. An illumination device for a purse as recited in claim 4, wherein said casing includes a socket for said light bulb that is connected via the electric circuit between said battery and said on/off switch.

6. An illumination device for a purse as recited in claim 5, further including a spring clip in the one side leg of said channel member of said bracket to better engage with the frame of the purse.

* * * * *